US006162894A

United States Patent [19]

Futamura

[11] Patent Number: 6,162,894

[45] Date of Patent: Dec. 19, 2000

[54] METHOD OF TREATING RESIN MATERIALS TO YIELD OILS

[75] Inventor: Shigeru Futamura, Tsukuba, Japan

[73] Assignee: Director-General of Agency of Industrial Science and Technology, Tokyo, Japan

[21] Appl. No.: 09/280,548

[22] Filed: Mar. 30, 1999

[30] Foreign Application Priority Data

Jul. 28, 1998 [JP] Japan ..... 10-212211

[51] Int. Cl.[7] ..... C08F 6/00

[52] U.S. Cl. ..... 528/480; 528/176

[58] Field of Search ..... 528/176, 480

[56] References Cited

FOREIGN PATENT DOCUMENTS 48-52866 7/1973 Japan .

7138576 5/1995 Japan .

*Primary Examiner*—Terressa M. Boykin

*Attorney, Agent, or Firm*—Birch, Stewart, Kolasch & Birch, LLP

[57] ABSTRACT

There is disclosed a method of treating a fire-retardant resin material, or a thermosetting resin material whose base is an epoxy resin or an ABS resin, to yield oil substances, which method comprises causing hydrocracking of a resin material in a hydrogen-donating solvent in the presence of a porous carbonaceous substance in a nitrogen atmosphere at 300 to 420° C., to yield an oil substance. According to the treatment method to yield oil substances, fire-retardant resin materials and thermosetting resin materials whose decomposition has hitherto been difficult, can be converted entirely to oil substances, which can be reused as fuels or the like, and the volume of the resin materials can be reduced considerably. Therefore, the method can greatly contribute to the waste disposal and recycling.

17 Claims, 2 Drawing Sheets

METHOD OF TREATING RESIN MATERIALS TO YIELD OILS

FIELD OF THE INVENTION

The present invention relates to a method of converting plastic wastes to yield oils that can be used as resources. More particularly, the present invention relates to a method of treating resin materials to yield oils, by hydrocracking fire-retardant resin materials or thermosetting resin materials whose conversion to oil substances has hitherto been difficult, thereby yielding oil substances.

BACKGROUND OF THE INVENTION

At present, a little over about 40% of waste plastics, which are discharged in an amount of about 5,000,000 tons annually in our country, are difficult to thermally crack to yield oil substances. Particularly, fire-retardant resin materials that contain fire-retardants, such as phosphates, bromides, etc., are widely used for bodies of personal computers and the like. Since the fire retardants impede hydrogen transfer reactions, or halogens are eventually mixed with the produced oil substances, the fire-retardant resin materials are difficult to convert to oil substances, in comparison with base matrix resins that are free from fire retardants. Decomposing these fire-retardant resin materials to yield oil substances entirely by a method that is less harmful to the environment and the human body leads to a reduction in waste materials and the attainment of fuel recycling or chemical recycling of waste materials. Accordingly, development of this method has been strongly required in recent years, now that the importance of environmental problems is highly stressed.

SUMMARY OF THE INVENTION

Accordingly, an object of the present invention is to provide a treatment method by which fire-retardant resin materials and the like, whose conversion to oil substances has hitherto been difficult, can be decomposed to yield oil substances.

Other and further objects, features, and advantages of the invention will appear more fully from the following description, taken in connection with the accompanying drawings.

DETAILED DESCRIPTION OF THE INVENTION

Figure 1:
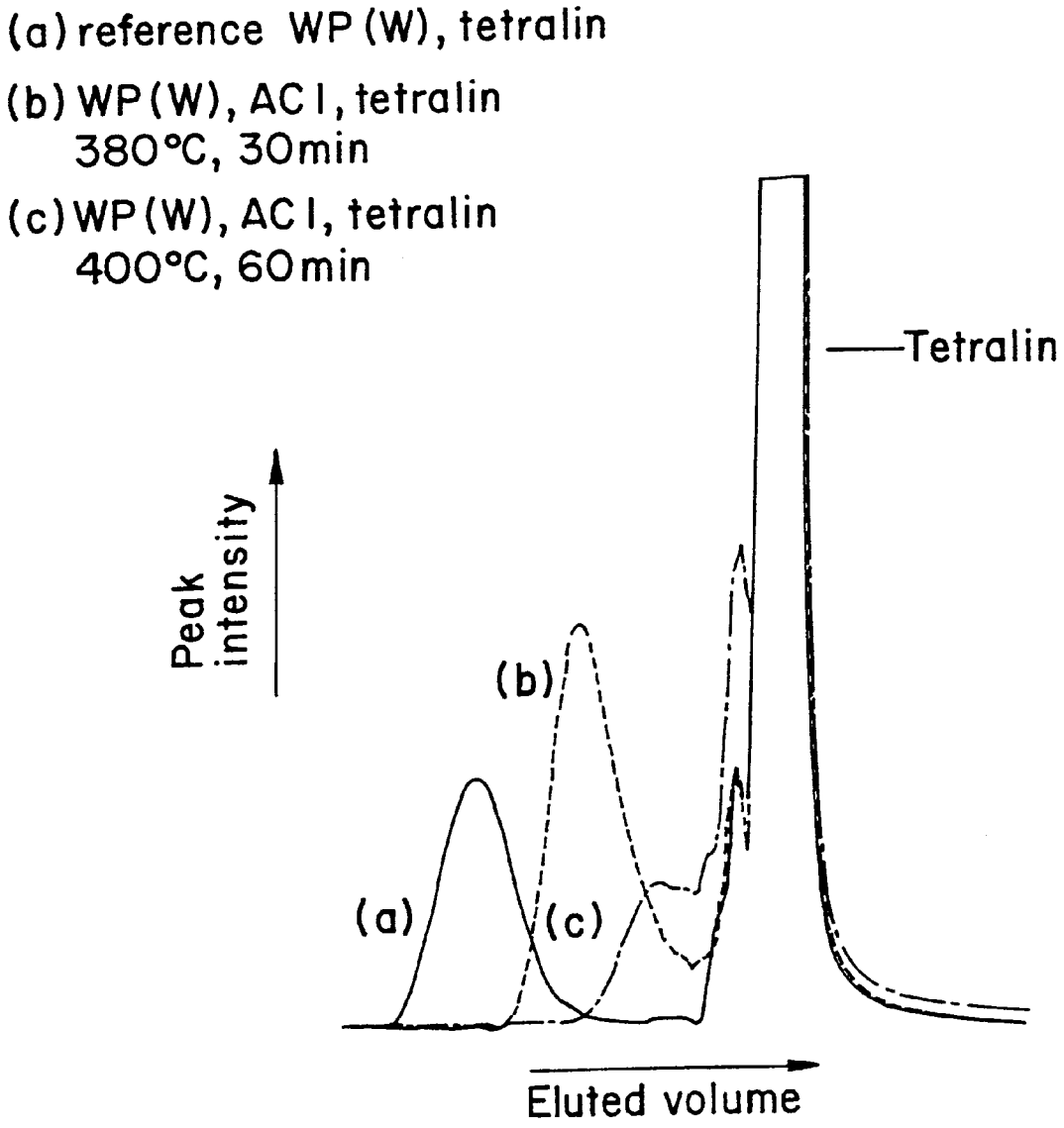
FIG. 1 shows the GPC profiles of the treated products of Examples 1 and 2.

In view of the above object, the inventor of the present invention has investigated intensively and has found that when a fire-retardant-containing resin material, an epoxy resin, or an ABS resin is treated in a hydrogen-donating solvent in the presence of a porous carbonaceous substance, it can cause hydrocracking reaction at 300 to 420° C. to yield an oil substance, which finding has led to the present invention.

That is, according to the present invention, there are provided:

(1) A method of treating fire-retardant resin materials to yield oil substances, comprising causing hydrocracking of a fire-retardant resin material in a hydrogen-donating solvent in the presence of a porous carbonaceous substance in an inert atmosphere at 300 to 420° C., to yield an oil substance;

(2) A method of treating thermosetting resin materials to yield oil substances, comprising causing hydrocracking of a thermosetting resin material whose base is an epoxy resin or an ABS resin in a hydrogen-donating solvent in the presence of a porous carbonaceous substance in an inert atmosphere at 300 to 420° C., to yield an oil substance; and (3) The method of treating resin materials to yield oil substances as stated in the above (1) or (2), wherein the porous carbonaceous material is an active carbon and/or a carbon black having a surface area of 1,000 $m^2/g$ or more.

Meantime, the hydrogen-donating solvent in this specification means a solvent that can release the hydrogen contained in the solvent itself, under the reaction conditions. Further, the surface area of the porous carbonaceous substance is measured by the BET method ($N_2$), unless otherwise stated.

The fire-retardant resin materials that can be treated to obtain oil substances by the method of the present invention, are resin materials containing fire retardants, and they include specifically, for example, a resin material having halogen atoms, phosphorus atoms, nitrogen atoms, or the like in the skeleton; a resin material containing a fire retardant, such as a phosphorus-series fire retardant [e.g., a phosphate (specifically, for example, ammonium dihydrogenphosphate ($NH_4H_2PO_4$)) and a phosphoric ester (e.g., tricresyl phosphate)], and an organobromine-series fire retardant (specifically, for example, tetrabromobisphenol A, octabromodiphenyl ether, decabromodiphenyl ether, and the like); and a resin material containing a crosslinking agent (e.g., 1,5-hexadien-3-yne). The content of the fire retardant is not particularly restricted. The base matrix resin is not particularly restricted to one and it includes, for example, a thermosetting resin, such as an epoxy resin and an acrylonitrile/butadiene/styren (ABS) resin, and a heat-resistant thermoplastic resin, such as a totally aromatic polymer.

Further, according to the method of the present invention, since a resin material containing a fire retardant whose decomposition is difficult can be converted to oil substances, a resin material free from any fire retardant can, of course, be treated and a thermosetting resin material whose base is an epoxy resin or an ABS resin can be treated.

The resin material that can be treated by the method of the present invention includes, specifically, for example, the casing (outer wall material) and chips of personal computers, medical plastic products (fluorine- containing materials), and automobile parts, each of which is made of fire-retardant resin materials. In the treatment, the resin material to be treated is preferably ground into pellets or the like before the treatment, and more preferably the ground particles have a particle diameter of 5 mm or less.

The solvent used in the present invention is a hydrogen-donating solvent, such as a partially hydrogenated aromatic hydrocarbon (e.g., tetralin (1,2,3,4-tetrahydronaphthalene) and an alkyl aromatic hydrocarbon (e.g., 1-methylnaphthalene) and preferably tetralin or 1-methylnaphtalene may be used. Depending on the catalytic activity of the porous carbonaceous substance, for example, decalin can be used as a hydrogen-donating solvent. The present invention is characterized in that the hydrocracking (hydrogenolysis) is occurred by means of the hydrogen generated from the solvent and the resin material to be treated, and therefore use of expensive hydrogen gas is not required. The amount of the solvent to be used varies depending, for example, on the type of the resin material to be treated, the type of the solvent, and the specifications of the reacting apparatus, and it is generally 3 ml or more and preferably 5 to 10 ml, per gram of the resin material.

The hydrocracking reaction of the resin material in the present invention is carried out in the above hydrogen-donating solvent in the presence of a porous carbonaceous substance. The porous carbonaceous substance that can be used in the present invention includes, for example, active carbon, carbon black, and mesocarbon microbeads, with preference given to an active carbon and/or carbon black having a large surface area and a large surface oxygen amount. The surface area of the porous carbonaceous substance is preferably 1,000 $m^2/g$ or more and more preferably 2,000 $m^2/g$ or more. The surface oxygen amount is preferably 5% or more, in terms of the surface chemical composition. In the present invention, the amount of the porous carbonaceous substance to be used is preferably 2 to 260 mg and more preferably 2 to 3 mg, per gram of the resin material to be treated.

It is presumed that the porous carbonaceous substance in the method of the present invention acts as a hydrogen transfer catalyst, and by using a carbon material itself, it can be less deactivated by hetero elements, such as a halogen and phosphorus.

The oil substance-yielding method of the present invention is required to be carried out at a temperature where the hydrogen-donating solvent used is not decomposed. The temperature is generally set in the range of 300 to 420° C. and preferably 300 to 400° C., although it may vary, depending on the type of the resin material to be treated. The use of the above solvent and porous carbonaceous substance allows the treatment to be carried out at a temperature lower by about 50 to 100° C. than that in the conventional reaction for thermal cracking of resin materials to yield oil substances.

The treatment of the present invention is carried out in an inert atmosphere, such as a nitrogen atmosphere and an argon atmosphere, and preferably a nitrogen atmosphere of 1 to 2 MPa. As the reactor, an autoclave or the like can be used, the material thereof is preferably one that is less corroded with acid gases or the like, and, use can be made of a heat-resistant nickel alloy autoclave made, for example, of Hastelloy C (trade name, manufactured by Haynes Stellite Co.). The reaction time varies depending on the types of the resin material and the solvent and is generally 30 to 60 min.

The oil-yielding treatment of the present invention permits a resin material to be decomposed to gaseous products and oils. It is presumed that the acid gases produced by the decomposition transfers quickly to the gaseous phase upon the generation thereof, and therefore it comes in contact with organic compounds in the oil phase less efficiently. For instance, by allowing the acid gases to be absorbed in water, the corrosion of the reactor can be prevented. Further, no formation of dioxins is found in either of the gaseous products and the oil substances.

Although the reaction mechanism of the decomposition reaction in the present invention is not necessarily clear, for example, when a resin material containing an organobromine-series fire retardant is treated by the method of the present invention, it is presumed that the reaction as shown in the following scheme takes place:

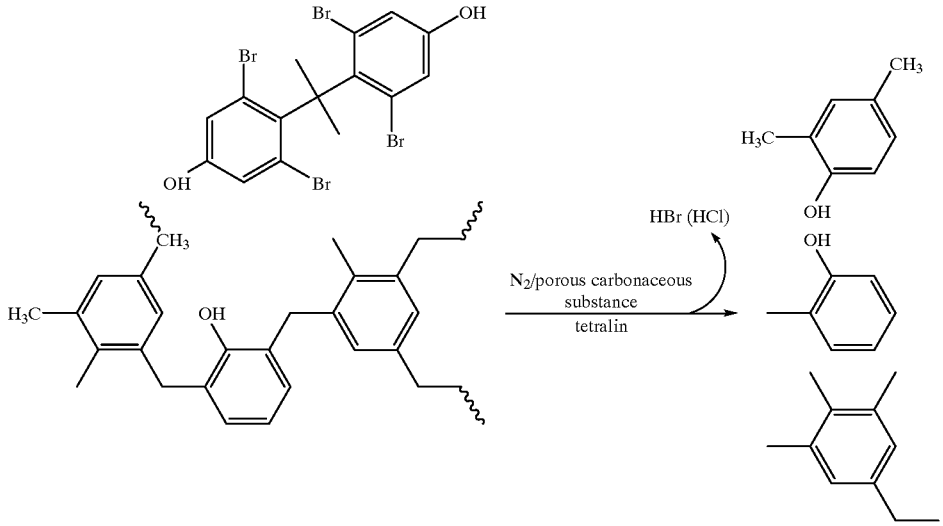

According to the method of the present invention, fire-retardant resin materials and thermosetting resin materials whose decomposition to yield oil substances has hitherto been difficult, can be converted entirely to oils, which can be reused as fuels or the like, and the volume of the fire-retardant resin materials and thermosetting resin materials can be reduced considerably. Therefore, the method of the present invention can greatly contribute to the waste disposal and recycling. Since in the present invention, it is not required to use expensive hydrogen gas and the reaction temperature is low in comparison with that of the conventional method, the cost of treating resin materials to yield oil substances can be reduced. Further, dioxins are not formed and waste resin materials can be treated without adverse effects on the environment.

Next, the present invention will be described in more detail based on the following examples, but the invention is not to be limited to them.

EXAMPLES

The surface chemical composition of the active carbon used was found by XPS (X-ray photoelectron spectroscopy).

Examples 1 and 2 and Comparative Example 1

5 g of pellet substance consisting of pelets having a diameter of 2 mm or less which were obtained by grinding a white outer-wall material (a resin material whose base matrix resin was an ABS-series resin and that contained an organobromine-series fire retardant, hereinafter referred to as WP(W)) of a personal computer, together with 80 ml of tetralin (obtained by purifying commercially available guaranteed reagent of tetralin in a usual manner) and 300 mg of active carbon (the surface area of 1,260 $cm^2/g$, and the surface chemical composition (%) of C, 82.68; H, 2.83; N, 0.80; S, 0.18; and O, 13.51, hereinafter referred to as AC 1) that had been deaerated and dried at 6 mmHg and 80° C. for 2 hours, were charged into a Hastelloy C electromagnetically stirred autoclave having a volume of 200 ml. After the autoclave was pressurized with nitrogen to 2.0 MPa and the temperature was elevated to 380° C., the reaction was carried out for 30 min. Further, the treatment was carried out in the same manner, except that the reaction temperature was changed to 400° C. and the reaction time was changed to 60 min. After the reaction, the autoclave was cooled in an ice-water to room temperature. In either case, the WP(W) was decomposed to yield an oil entirely, to give a pale yellow oil substance in an amount about 5 g, respectively.

The products thus resulting from the oil-yielding treatment were analyzed as follows:

After the gaseous products were passed through a washing pipe that was filed with water, the gaseous products were taken into a Tedlar's bag and were identified by GC-MS. Carbon monoxide, carbon dioxide, methane, ethane, ethylene, benzene, toluene, and ethylbenzene were measured quantitatively using a reference gas. The other products were recovered by adding 120 ml of tetrahydrofuran (THF) and the solid component was filtered off by filtration under reduced pressure. The THF solution of the reaction products was directly subjected to GPC (gel permeation chromatography) (TOSOH Model CCP & 8020; column: GMHHR-M 30 cm×2; the eluent: THF) analysis.

It was confirmed that all of the acid gases evolved was absorbed in the water. Further, it was not recognized that the autoclave was corroded with the acid gases. When the solids in the product obtained by the decomposition treatment were washed with hexane three times, then it was dried and weighed, it was found that the weight corresponded approximately to the weight of the inorganic components originally contained in WP(W). Thus it was assumed that almost no polycondensation products insoluble in THF were formed.

Further, the reaction mixture was diluted with a given quantity of chloroform, and the conversion of the solvent tetralin was determined by FID (free induction decay)-GC to be 2.6%. Thus it was confirmed that the tetralin was converted to naphthalene in the reaction, i.e., it acted as a hydrogen donor.

The results of the GC-MS analyses are shown in Table 1. The results of the treatment carried out in the same manner as the above, but in the absence of the porous carbonaceous substance, are also shown in Table 1, as the results of Comparative Example 1. In Comparative Example 1 wherein the porous carbonaceous substance was not used, after the reaction, about 1 g of brown wax-like components hardly soluble in THF was formed. On the other hand, in Examples 1 and 2 wherein AC 1 was used, such a phenomenon was not observed. From the results of Examples 1 and 2 shown in Table 1, it can be seen that in comparison with those of Comparative Example 1 wherein AC 1 was not used, the produced amounts of methane, ethane, benzene, and toluene were large and the produced amount of carbon dioxide was small. It was presumed that this was because the hydrogen transfer from tetralin, was accelerated by AC 1.

In Examples 1 and 2 and Comparative Example 1, in addition to carbon monoxide, carbon dioxide, methane, ethane, ethylene, benzene, toluene, and ethylbenzene, as shown in Table 1, very small amounts of 2-methylpropane and butane were produced. With respect to nitrites, 2-methylpropanenitrile was detected in a very small amount, but hydrogen cyanide and cyanogen bromide were not detected. In Comparative Example 1, the produced amounts of organic cyano-compounds were large in comparison with Examples 1 and 2. Further, in Examples 1 and 2, no formation of dioxins was recognized in the gaseous products or in the oil.

TABLE 1

| Treated Plastic | Porous carbonaceous substance | Reaction temperature (° C.) | Reaction time (min) | Product (ppm) Carbon monoxide | Carbon dioxide | Methane | Ethane | Ethylene | Benzene | Toluene | Ethyl-benzene | Remarks |
|---|---|---|---|---|---|---|---|---|---|---|---|---|
| WP (W) | AC 1 | 380 | 30 | 818 | 935 | 160 | 57 | 82 | 3 | 4 | 4 | Example 1 |
| WP (W) | AC 1 | 400 | 60 | 3876 | 881 | 1717 | 420 | 108 | 4.7 | 12 | 5.1 | Example 2 |
| WP (W) | none | 380 | 30 | 1109 | 693 | 184 | 92 | 159 | 2 | 2 | 1 | Comparative example 1 |
| WP (B) | AC 1 | 380 | 30 | 684 | 1101 | 118 | 24 | 29 | 3 | 2.2 | 1 | Example 3 |
| WP (B) | none | 380 | 30 | 317 | 238 | 36 | 12 | 19 | 1 | 1 | — | Comparative example 2 |

With respect to the composition of the obtained oils, the elution time of GPC was such that, in Example 1 (38° C., 30 min), a period of 16.7 min accounted for 21.2%, a period of 21.5 min accounted for 0.6 %, and a period of 27.0 min accounted for 77.5%. In Example 2 (400° C., 60 min), a period of 19.23 min accounted for 7.7%, a period of 21.5 min accounted for 1.3%, and a period of 22.0 min accounted for 90.5%. In the case of WP(W) itself, a period of 13.8 min accounted for 100%, and then by comparing the former two samples with this, it can be understood that in Examples 1 and 2, almost all of the resin was decomposed to compounds having molecular weights lower than that of WP(W).

Their GPC profiles are shown in FIG. 1 [(a) indicates WP(W) itself, (b) indicates Example 1, and (c) indicates Example 2].

In FIG. 1, in comparison to (a), (b) shows that the peak is shifted to a position where the elution volume is larger, indicating that the base matrix resin of WP(w) was decomposed to have lower molecular weights, and that in (c) wherein the reaction was carried out at a higher temperature and for a longer period than (b), the molecular weights were further reduced. Since the peak of (c) little overlaps with the peak of (a), it is presumed that in (c), the components of WP(W) remained little. A large excess of tetralin was present for WP(W) and it can be seen that along with the progress of the decomposition reaction, components whose elution positions overlap with that of tetralin were produced, and their amounts produced increased in conformity with the degree of the lowering of molecular weights.

Example 3 and Comparative Example 2

The treatment was carried out in the same manner as in Example 1, except that in place of WP(W), use was made of a black outer-wall material (a resin material whose base matrix resin was an ABS-series resin and that contained an organobromine-series fire retardant, hereinafter referred to as WP(B)) of a personal computer, thereby it was possible to entirely convert it to an oil, to give a pale yellow oil substance in an amount of about 5 g. The color stability of the oil substance was higher than that of Example 1. This product was analyzed in the same manner as in Example 1.

The results of GC-MS of the gaseous products are shown in Table 1. The results of the treatment carried out in the same manner as the above but in the absence of the porous carbonaceous substance, are also shown as the results of Comparative Example 2, in Table 1. In Comparative Example 2 wherein the porous carbonaceous substance was not used, after the reaction, about 0.4 g of brown wax-like components hardly soluble in THF was produced, but in Example 3 wherein AC1 was used, such a phenomenon was not observed. In comparison with Example 1, in the treatment of WP(B), the amount of the gaseous products was small.

With respect to the composition of the oil-substance obtained, the elution time of GPC was such that a period of 14.7 min accounted for 28.4% and a period of 22.4 min accounted for 70.0%.

Figure 2:
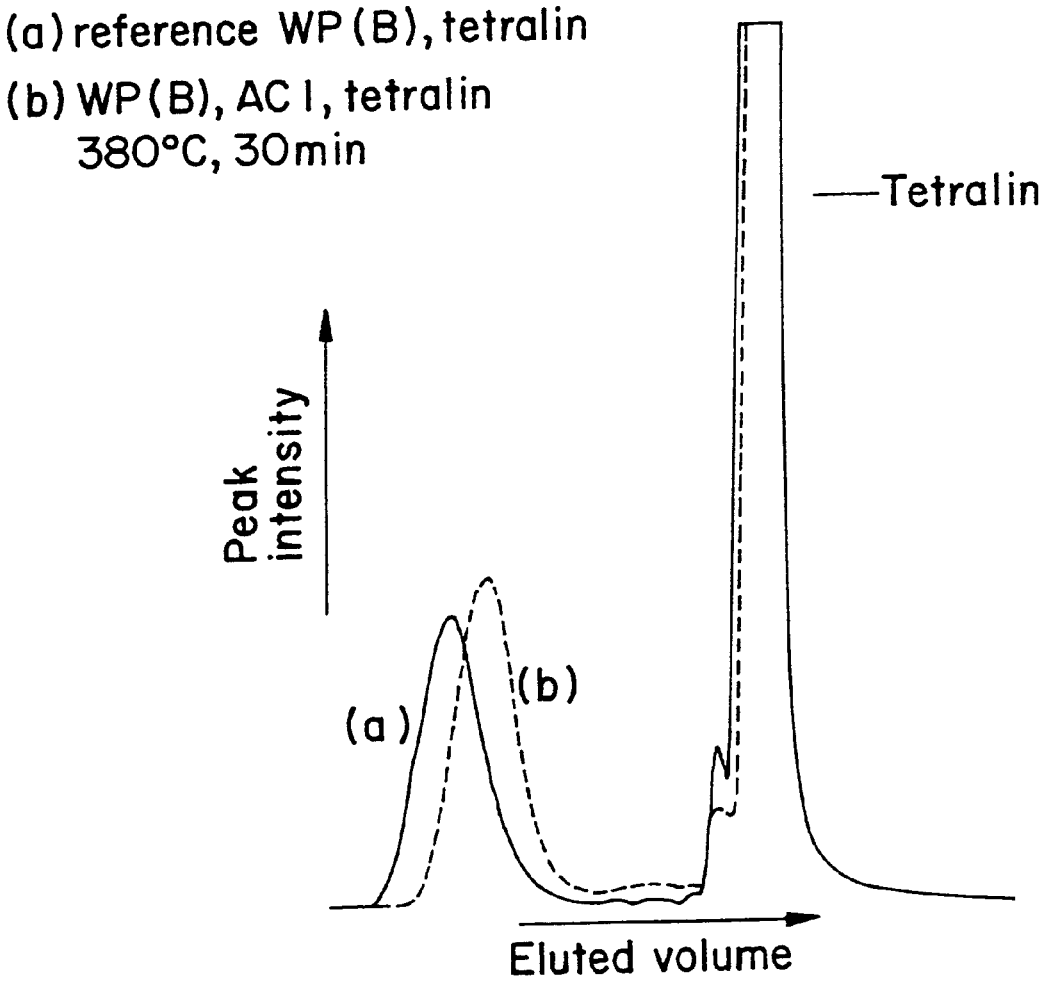
FIG. 2 shows the GPC profile of the treated product of Example 3.

The GPC profile of the THF solution of this reaction mixture, together with the profile of WP(B) itself, is shown in FIG. 2. From the results shown in FIG. 2, it can be understood that WP(B) was decomposed by the oil-yielding method of the present invention, to have lower molecular weights, but the degree of lowering of the molecular weight was a little lower than for WP(W).

Examples 4 and 5

The treatment was carried out in the same manner as in the case of Example 1, except that in place of WP(W), an epoxy resin material or an ABS resin material was used, thereby it was possible to convert it to an oil entirely, to give a yellow oil substance or a pale yellow oil substance, respectively.

In the decomposition of the ABS resin material, a gaseous product whose composition was similar to that of the product produced in the decomposition reaction of the WP(W) was formed. With respect to the composition of the oil, the elution time of GPC was such that a period of 15.9 min accounted for 14.2%, a period of 21.4 min accounted for 10.1%, and a period of 22.3 min accounted for 75.5%.

In the decomposition of the epoxy resin material, the composition of the gaseous products was such that carbon monoxide accounted for 2.2%, carbon dioxide accounted for 1,229 ppm, methane accounted for 7,935 ppm, ethylene accounted for 260 ppm, and ethane accounted for 2,055 ppm, and with respect to the composition of the oil, the elution time of GPC was such that a period of 19.5 min accounted for 18.0%, a period of 20.0 min accounted for 20.7%, and a period of 21.2 min accounted for 61.3%.

Having described our invention as related to the present embodiments, it is our intention that the invention not be limited by any of the details of the description, unless otherwise specified, but rather be construed broadly within its spirit and scope as set out in the accompanying claims.

What I claim is:

1. A method of treating fire-retardant resin materials to yield oil substances, comprising causing hydrocracking of a fire-retardant resin material in a hydrogen-donating solvent in the presence of a porous carbonaceous substance in an inert atmosphere at 300 to 420° C., to yield an oil substance.

2. The method of treating resin materials to yield oil substances as claimed in claim 1, wherein the porous carbonaceous material is an active carbon and/or a carbon black having a surface area of 1,000 $m^2/g$ or more.

3. A method of treating thermosetting resin materials to yield oil substances, comprising causing hydrocracking of a thermosetting resin material whose base is an epoxy resin or an ABS resin in a hydrogen-donating solvent in the presence of a porous carbonaceous substance in an inert atmosphere at 300 to 420° C., to yield an oil substance.

4. The method of treating resin materials to yield oil substances as claimed in claim 3, wherein the porous carbonaceous material is an active carbon and/or a carbon black having a surface area of 1,000 $m^2/g$ or more.

5. The method of claim 1, wherein the fire-retardant resin materials are selected from the group consisting of a resin material having halogen atoms, a resin material having phosphorus atoms, a resin material having nitrogen atoms, and a resin material containing a cross-linking agent.

6. The method of claim 1, wherein the hydrogen donating solvent is a partially hydrogenated aromatic hydrocarbon or an alkyl aromatic hydrocarbon.

7. The method of claim 3, wherein the hydrogen donating solvent is a partially hydrogenated aromatic hydrocarbon or an alkyl aromatic hydrocarbon.

8. The method of claim 1, wherein the hydrogen donating solvent is tetralin 1,2,3,4-tetrahydronaphthalene or methylnaphthalene.

9. The method of claim 3, wherein the hydrogen donating solvent is tetralin 1,2,3,4-tetrahydronaphthalene or 1-methylnaphthalene.

10. The method of claim 1, wherein the method is conducted in the absence of hydrogen gas.

11. The method of claim 3, wherein the method is conducted in the absence of hydrogen gas.

12. The method of claim 1, wherein the amount of solvent is 3 ml or more per gram of the resin material.

13. The method of claim 3, wherein the amount of solvent is 3 ml or more per gram of the resin material.

14. The method of claim 1, wherein the amount of porous carbonaceous substance is 2 to 260 mg per gram of resin material to be treated.

15. The method of claim 3, wherein the amount of porous carbonaceous substance is 2 to 260 mg per gram of resin material to be treated.

16. The method of claim 1, wherein the hydrogen donating solvent transfers hydrogen atom to said resin in a liquid phase.

17. The method of claim 3, wherein the hydrogen donating solvent transfers hydrogen atom to said resin in a liquid phase.

* * * * *